US008813908B1

(12) United States Patent
Liu et al.

(10) Patent No.: US 8,813,908 B1
(45) Date of Patent: Aug. 26, 2014

(54) HVAC BLOWER WITH NOISE SUPPRESSION FEATURES

(71) Applicant: Ford Global Technologies, LLC, Dearborn, MI (US)

(72) Inventors: Zhengyu Liu, Novi, MI (US); Ahmed Cherif, Ann Arbor, MI (US); Curtis Mark Jones, Wixom, MI (US); Steven Pryor Perry, Rochester Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/790,704

(22) Filed: Mar. 8, 2013

(51) Int. Cl.
*F01N 1/12* (2006.01)

(52) U.S. Cl.
USPC ..... 181/279; 181/225; 415/119

(58) Field of Classification Search
CPC ..... F01N 1/12; F04D 29/665
USPC ..... 181/279, 225; 415/119
See application file for complete search history.

(56) References Cited

U.S. PATENT DOCUMENTS

| | | | | |
|---|---|---|---|---|
| 5,551,836 | A | 9/1996 | Roth et al. | |
| 5,934,366 | A | 8/1999 | Gowan | |
| 7,431,127 | B2 * | 10/2008 | de Borchgrave et al. | 181/229 |
| 7,744,342 | B2 * | 6/2010 | Kamoshita et al. | 415/119 |
| 7,942,234 | B2 * | 5/2011 | Utsunomiya | 181/225 |
| 7,990,701 | B2 * | 8/2011 | Yeh et al. | 361/679.48 |
| 8,083,477 | B2 * | 12/2011 | Hwang et al. | 415/206 |
| 8,251,642 | B2 * | 8/2012 | Hwang et al. | 415/102 |
| 2007/0209353 | A1 | 9/2007 | Zelinski | |
| 2010/0104421 | A1 * | 4/2010 | Hwang et al. | 415/119 |

* cited by examiner

*Primary Examiner* — Forrest M Phillips
(74) *Attorney, Agent, or Firm* — Vichit Chea; Brooks Kushman P.C.

(57) ABSTRACT

A blower for an HVAC system of a motor vehicle. A fan is supplied with airflow by a duct having a bend adjacent to the fan that causes a low-pressure region at a face of the fan. A baffle is located immediately adjacent to the fan face and collocated with at least a portion of the low-pressure region to impede airflow through the face of the fan at that location. The baffle acts to reduce unwanted low frequency noise and improves the mechanical efficiency of the fan. The baffle covers a circular segment of the fan face and may have sound-suppressing features, such as ridges formed on at least one surfaces.

17 Claims, 2 Drawing Sheets

HVAC BLOWER WITH NOISE SUPPRESSION FEATURES

TECHNICAL FIELD

The present invention relates to a blower assembly for use in a motor vehicle heating, ventilation and air conditioning (HVAC) system, and more specifically to such a blower assembly having an inlet configured to suppress fan noise.

BACKGROUND

Most automotive vehicles have an HVAC system that includes an electrically powered blower to circulate air through the enclosed cabin of the vehicle.

It is common for a motor vehicle HVAC system to include ducts carrying inlet air from two separate sources: fresh air from outside the vehicle and recirculated air from within the vehicle. Because of packaging space constraints, it may not be practical to arrange both the recirculation and fresh air ducts so as to feed directly into the fan, so that the fan inlet duct(s) may have a sharp bend close to the fan.

It is a well-recognized problem that abrupt or sharp bends in the inlet duct delivering airflow to a fan may cause flow disruptions. Such flow disruptions may be particularly severe if the sharp bend is close to the blower fan itself. If the flow disruption creates turbulence and/or a low-pressure region at a region of the inlet face of the fan, it may result in undesirable noise under certain airflow and fan speed conditions. Such flow disruptions and related low-pressure regions can also reduce the blower system efficiency.

SUMMARY

In a first disclosed embodiment, a motor vehicle HVAC blower comprises a fan and a duct delivering airflow to the fan. The duct has a bend adjacent to the fan causing a low-pressure region at a face of the fan. A baffle is located immediately adjacent to the fan face and collocated with at least a portion of the low-pressure region to impede airflow through the face of the fan at that location. The baffle acts to reduce unwanted low frequency noise and improves the mechanical efficiency of the fan.

In another disclosed embodiment, the baffle covers a circular segment of the fan face.

In another disclosed embodiment, a surface of the baffle facing the fan face comprises a sound-suppressing feature. The sound-suppressing feature may comprise a series of ridges extending in a chord-wise direction.

In another disclosed embodiment, the duct comprises a first inlet path receiving air from a vehicle exterior, and a second inlet path receiving air from a vehicle interior.

In another disclosed embodiment, a method of reducing noise from an HVAC blower comprises identifying a low-pressure region at a face of a fan caused by a bend in a duct supplying air to the fan, and positioning a baffle immediately adjacent to the fan face and adjacent to at least a portion of the low-pressure region to impede airflow therethrough.

BRIEF DESCRIPTION OF THE DRAWINGS

Embodiments of the present invention described herein are recited with particularity in the appended claims. However, other features will become more apparent, and the embodiments may be best understood by referring to the following detailed description in conjunction with the accompanying drawings, in which:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
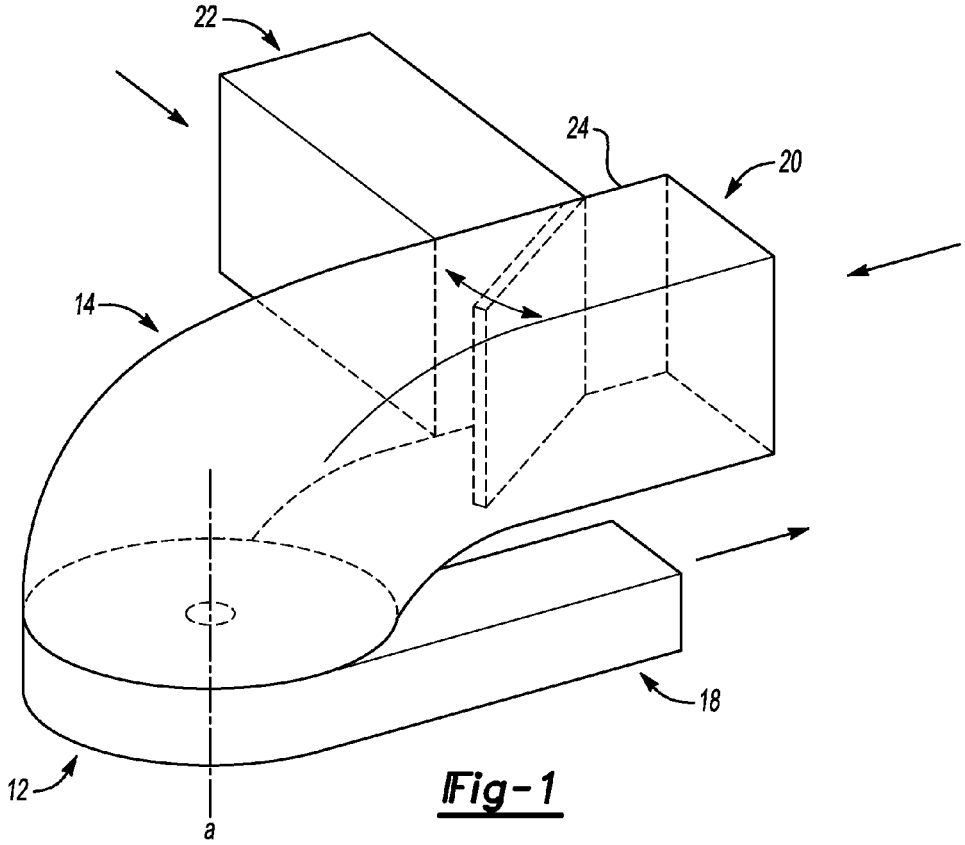
FIG. 1 is a schematic exploded view of a blower and inlet duct assembly of a motor vehicle HVAC system.

FIG. 1 shows a blower unit 12 and an inlet duct 14. Blower 12 is a centrifugal blower in which a fan 16 (see FIG. 2) rotates about an axis a to draw air supplied by inlet duct 14 and force it through an outlet duct 18.

Inlet duct 14 has a first inlet path 20 and a second inlet path 22 which merge prior to feeding into blower 12. A mixer door 24 is movable to select or blend the air streams supplied by first and second inlet paths 20, 22. In a common configuration of a motor vehicle HVAC system, first air inlet path 20 supplies fresh air drawn from the exterior of the vehicle, while second air inlet path 22 supplies recirculated air drawn from the vehicle interior. The position of valve plate 24 may be manually or automatically controlled in response to various climate control settings of the HVAC system as is well known in the art.

Figure 2:
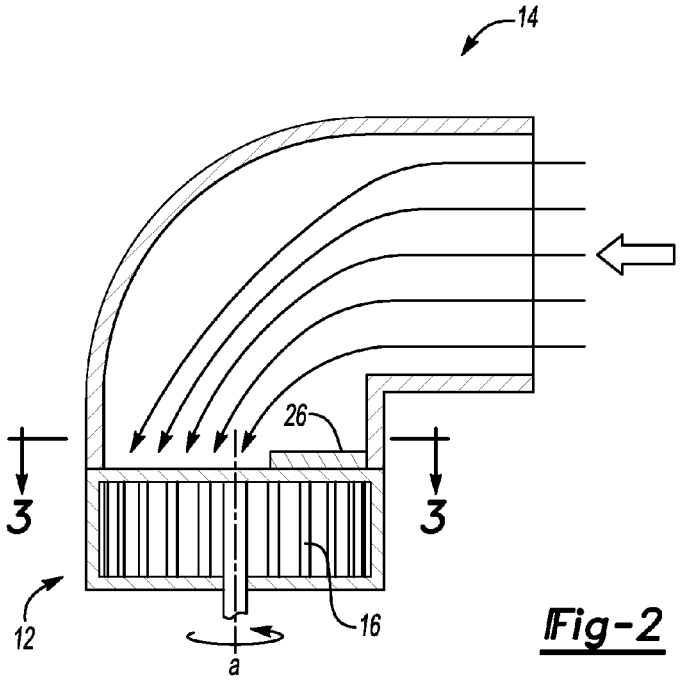
FIG. 2 is a schematic cross-sectional view of the blower fan and inlet duct.

As seen in FIG. 2 the airflow travelling through duct 14 must make a sharp or abrupt turn through approximately 90 degrees to reach the inlet face of fan 16. The flow disruption caused by this abrupt change in direction may cause a non-uniform velocity profile over the area of the inlet face of the fan, and a consequent low-pressure region adjacent to the inside of the curved path of the airflow, where the radius of the curved path is smallest. The flow disruptions may be particularly troublesome if the bend occurs close to the fan inlet face. For example, FIG. 2 shows a duct geometry in which the length of common inlet path 23 (as so the distance between the bend and the fan face) is less than the diameter of the duct.

A baffle 26 is located generally parallel with the inlet face of fan 16 and impedes airflow from directly entering the fan in the predicted or known location of the low-pressure region that may result from the sharp bend of the airflow. Impeding airflow to the inlet face of the fan in that low-pressure region is intended to uniformly distribute the airflow over the remaining surface of the fan face that is not blocked by the baffle. The baffle 26 thus serves to improve blower efficiency by reducing system pressure drop and may also reduce objectionable noise, particularly low-frequency noise.

Figure 3:
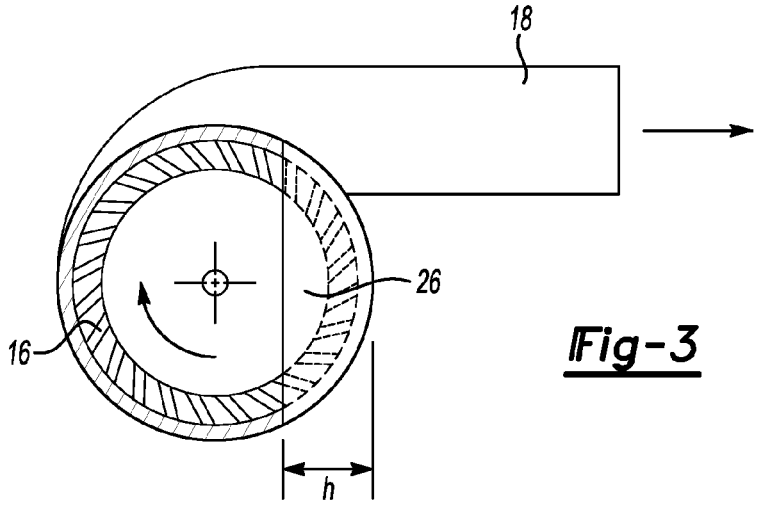
FIG. 3 is a view taken along section line 3-3 of FIG. 2.

As seen in FIG. 3, baffle 26 may have the shape of a circular segment of a height h. While the baffle 26 is shown positioned adjacent to inside of the curved airflow path, the most advantageous positioning of the baffle may be determined by computational fluid dynamics modeling and/or real world testing of specific duct geometries. The optimum height h of the baffle may also be determined by simulations or real-world testing.

The height h may be advantageously selected to be approximately 5% to approximately 15% of the diameter of fan 16. It should be noted that the present figures are not drawn to scale, and as such the height h of baffle 26 may, for clarity of illustration, appear to be greater than 15% of the fan face diameter.

The geometry of inlet dust 14 shown in FIG. 1 is by way of example only, and the present invention is also applicable to a duct having any number of inlet flow paths disposed in any configuration that may result in disrupted airflow reaching the inlet face of the blower fan.

Figure 4A:
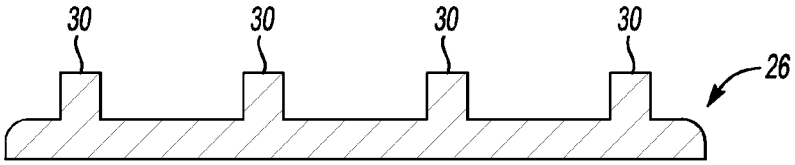
FIGS. 4A-4C show schematic examples of airflow baffles having sound-suppressing features.
Figure 4B:
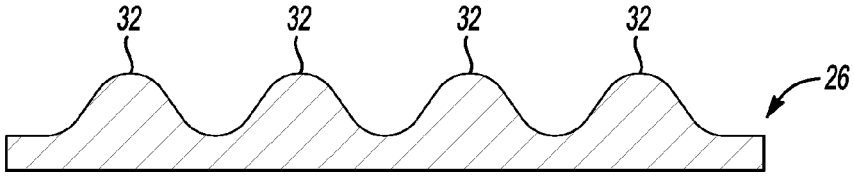
Figure 4C:
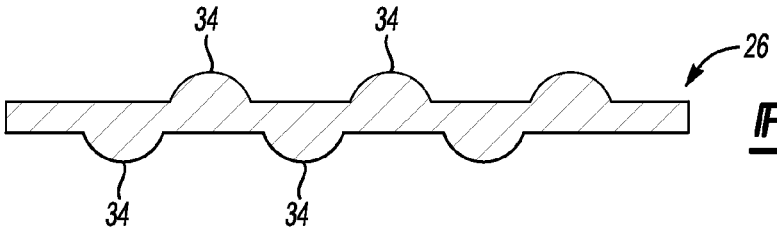

FIGS. 4A-4C are cross-sectional views of possible alternative baffle designs showing a variety of sound-suppressing features formed on one or more of the faces of the baffle. The sound-suppressing features may, for example, be designed to reduce blade passing frequency (BPF) tones/noise.

In FIG. 4A, the sound-suppressing features comprise a series of ridges 30 projecting from the surface of the baffle that is oriented towards the fan inlet face, shown as the upper facing surface in the figures. Ridges 30 may have a generally rectangular cross-section.

In FIG. 4B, the sound-suppressing features comprise a series of ridges 32 having a generally sinusoidal cross-section. As in the embodiment of FIG. 4A, the ridges 32 are arranged only on the surface of baffle 26 oriented towards the fan inlet face.

FIG. 4C shows another alternative embodiment of a baffle 26 in which sound-suppressing ridges 34 are formed on both surfaces of the baffle.

In one or more of the embodiments shown in FIGS. 4A through 4C, the sound-suppressing features 30, 32, 34 may project approximately 4-5 millimeters from the surface of the baffle 26.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A blower comprising:

a fan;

a duct delivering airflow to the fan and having a bend causing a low-pressure region at a face of the fan; and an air-impermeable baffle immediately adjacent to and covering only a circular segment of the fan face collocated with at least a portion of the low-pressure region to impede airflow therethrough.

2. The blower of claim 1 wherein the circular segment covered by the baffle has a height of from approximately 5% to approximately 15% of a diameter of the fan face.

3. The blower of claim 1 wherein a surface of the baffle facing the fan face comprises a sound-suppressing feature.

4. The blower according to claim 3 wherein the sound-suppressing feature comprises a series of ridges extending in a chord-wise direction.

5. The blower of claim 1 wherein the baffle is at an inside of the bend of the duct.

6. The blower of claim 1 wherein the duct comprises a first inlet path receiving air from an exterior of a motor vehicle, and a second inlet path receiving air from an interior of the vehicle.

7. The blower of claim 6 further comprising a selector valve operable to determine a portion of air reaching the fan from the first inlet path and the second inlet path.

8. The blower of claim 1 wherein the baffle comprises a plate generally parallel to the fan face.

9. A blower comprising:

a fan;

a duct delivering airflow to the fan and having a bend of approximately 90 degrees causing a low-pressure region at a face of the fan; and a baffle immediately adjacent to and generally parallel to the fan face, the baffle being a circular segment shape and collocated with the low-pressure region to block airflow therethrough.

10. The blower of claim 9 wherein the circular segment covered by the baffle has a height of from approximately 5% to approximately 15% of a diameter of the fan face.

11. The blower of claim 9 wherein a surface of the baffle facing the fan face comprises a sound-suppressing feature.

12. The blower according to claim 11 wherein the sound-suppressing feature comprises a series of ridges extending in a chord-wise direction.

13. The blower of claim 9 wherein the baffle is at an inside of the bend of the duct.

14. A method of reducing noise from a blower comprising:

identifying a low-pressure region at a face of a fan caused by a bend in a duct supplying air to the fan; and positioning an air-impermeable baffle having a circular segment shape immediately adjacent to the fan face and adjacent to at least a portion of the low-pressure region to impede airflow therethrough.

15. The method of claim 14 wherein the baffle is further positioned parallel with the fan face.

16. The method of claim 14 wherein the circular segment covered by the baffle has a height of from approximately 5% to approximately 15% of a diameter of the fan face.

17. The method of claim 14 wherein a surface of the baffle comprises a sound-suppressing feature, the baffle being positioned with the sound-suppressing feature adjacent to the fan face.

* * * * *